US008596031B2

(12) United States Patent
Pearl et al.

(10) Patent No.: US 8,596,031 B2
(45) Date of Patent: Dec. 3, 2013

(54) WRAP DISPENSING STATION AND METHOD

(75) Inventors: Jayson Pearl, Shorewood, WI (US); Tom Wozny, Cary, IL (US); Paul A. Omdoll, Waukesha, WI (US); Norm Faiola, Ithaca, NY (US)

(73) Assignee: San Jamar, Inc., Elkhorn, WI (US)

( * ) Notice: Subject to any disclaimer, the term of this patent is extended or adjusted under 35 U.S.C. 154(b) by 1174 days.

(21) Appl. No.: 11/438,192

(22) Filed: May 22, 2006

(65) Prior Publication Data

US 2007/0034320 A1 Feb. 15, 2007

Related U.S. Application Data

(60) Provisional application No. 60/683,487, filed on May 20, 2005.

(51) Int. Cl.
*B65B 13/00* (2006.01)

(52) U.S. Cl.
USPC ..... 53/588; 225/19; 225/39

(58) Field of Classification Search
USPC ..... 53/556, 588, 589, 411; 83/175, 456, 83/610, 649; 225/19, 39, 43, 46, 89; 206/409, 411, 373
See application file for complete search history.

(56) References Cited

U.S. PATENT DOCUMENTS 556,068 A * 3/1896 Schloss ..... 242/594.3
2,462,816 A * 2/1949 Schner, Jr. ..... 312/34.23
2,463,037 A * 3/1949 Holm ..... 312/34.23
2,550,209 A * 4/1951 Tuttle ..... 242/594.5
3,698,600 A * 10/1972 Foote ..... 221/70
4,119,251 A * 10/1978 Golner et al. ..... 225/20
4,196,647 A * 4/1980 Fish ..... 83/175
4,286,488 A * 9/1981 Mason ..... 83/205
4,417,495 A * 11/1983 Gordon et al. ..... 83/175
D272,021 S * 1/1984 Ruff ..... D6/518
4,735,342 A * 4/1988 Goldstein ..... 221/25
4,850,177 A * 7/1989 Kaczkowski et al. ..... 53/556
4,951,858 A * 8/1990 Krall ..... 225/19
4,957,023 A * 9/1990 Chen ..... 83/372
4,960,022 A * 10/1990 Chuang ..... 83/175
5,025,692 A * 6/1991 Reynolds ..... 83/468
5,044,241 A * 9/1991 Labrecque ..... 83/489
5,129,565 A * 7/1992 Miller ..... 225/38
5,292,046 A * 3/1994 Kaiser et al. ..... 225/19
D347,345 S * 5/1994 Kaiser et al. ..... D6/518
5,667,121 A * 9/1997 Hill ..... 225/43
D396,978 S * 8/1998 Kaiser et al. ..... D6/518

(Continued)

*Primary Examiner* — Sameh H. Tawfik
(74) *Attorney, Agent, or Firm* — Boyle Fredrickson, S.C.

(57) ABSTRACT

The present invention relates to a wrap dispensing station and a method for wrapping food products for storage. A selected size roll of material used to wrap food products is mounted in a housing. The leading edge of the roll of material is fed through a slot in the housing. At least one roll of labels is staged in a storage area in the housing. The leading edge of the labels is fed through a label feeding system. At least one writing implement is preferably staged in the storage area in the housing. The leading edge of the roll of material is pulled to a selected length to be used to wrap a food product. A cutting apparatus is used to cut the selected length of material. The food product is wrapped with the selected length of material. A label is removed from the roll of labels, marked with the staged writing implement and placed on the wrapped food product.

10 Claims, 8 Drawing Sheets

(56) References Cited

U.S. PATENT DOCUMENTS

| | | | | |
|---|---|---|---|---|
| 5,799,471 | A * | 9/1998 | Chen | 53/556 |
| 6,419,113 | B1 * | 7/2002 | Tramontina | 221/45 |
| 6,553,884 | B1 * | 4/2003 | Luhmann et al. | 83/649 |
| 6,644,155 | B2 * | 11/2003 | Phelps et al. | 83/339 |
| 6,684,751 | B2 * | 2/2004 | Kapiloff et al. | 83/649 |
| 6,981,355 | B2 * | 1/2006 | McClure et al. | 53/399 |
| 6,988,437 | B2 * | 1/2006 | Granger | 83/335 |
| 7,082,740 | B2 * | 8/2006 | van der Lely | 53/411 |
| 7,168,653 | B2 * | 1/2007 | Omdoll et al. | 242/564.2 |
| 7,500,635 | B2 * | 3/2009 | Cooper et al. | 242/588.6 |

* cited by examiner

WRAP DISPENSING STATION AND METHOD

CROSS-REFERENCE TO RELATED APPLICATIONS

This application claims priority under 35 U.S.C. § 119(e) to U.S. Provisional Application Serial No. U.S. Ser. No. 60/683,487, filed May 20, 2005.

FIELD OF THE INVENTION

This invention relates generally to dispensers for wrapping material and more particularly to a system and method for wrapping and storing food.

BACKGROUND OF THE INVENTION

In food service operations, film and foil are frequently used in large quantities to wrap unused food items including both prepared and raw food products. Given the typical food service environment, it is generally problematic to rely on the large cardboard box in which film and foil are typically packaged because such boxes get wet and dirty and can break down and cause contamination. As a result, over the years, food service users have turned to substitutes that purport to provide improved reliability and cleanliness.

Two examples of such substitutes are shown in U.S. Design Pat. Nos. D396,978 and D347,345. Both of these patents show substantially rectangular cases having hinged lids. U.S. Design Pat. No. D347,345 also shows the use of handles in conjunction with the hinged rectangular box. Other prior art products include the "Safety Wrap" device marketed by The Colman Group, Inc., the assignee of the present application. This product includes additional features such as a static cling strip to keep film in a "ready position," wall mount ability, retractable plastic blades, plastic construction and optional shelf hanging.

While these aftermarket foil and film dispensers do provide a substantial improvement over the typical film or foil cardboard box, they fail to provide a place for tools and labels frequently required as part of the process of wrapping up and storing unused food items. More particularly, in most food service operations, when unused food items are wrapped and placed back on a shelf, in a refrigerator or in a freezer, they must be marked to indicate the storage date, the destruction date and or the type of food item inside the wrapping. This marking is generally accomplished using markers, rotation labels and/or scissors. Since they cannot be stored with the film or foil, such items are often left out on the counter from which they get lost, dropped, stolen or contaminated. Still further, when labels must be marked, given the general state of counters in food service operations, there may be no "safe" or dry surface on which to mark them.

Another issue with the prior art aftermarket film and foil dispensers is their inability to readily accommodate different size rolls of film or foil. While film and foil can generally be obtained in a standard size that corresponds to the size of a chosen dispenser, other sizes of film and foil are available and may be more appropriate for different types of food products and service requirements. In such cases, users have no choice but to either use standard size film or foil, maintain non-standard sizes in their original cardboard box or purchase multiple size aftermarket dispensers—to the extent they even exist.

Accordingly, a need exists for an improved foil and film dispenser that overcomes one or more of the prior art drawbacks.

SUMMARY OF THE INVENTION

In one preferred embodiment of the present invention a housing is provided that securely holds a roll of foil or film and protects the film or foil from general environmental contamination. The housing comprises top and bottom portions, hinged together with a secure latch mechanism. The housing also includes two handles for readily moving the dispensing station of the present invention from place to place.

The present invention also provides storage areas for labels, markers and scissors. Preferably, the storage areas are covered such that the markers, labels and scissors are protected from liquids and other possible contaminants. When labels are provided in rolls, the present invention also preferably provides a means for dispensing the labels as well as a semi-flat writing surface for marking on the labels.

Preferably the present invention also includes a means for dispensing rolls of film or foil of varying size. It accomplishes this by providing an adjustable support system that can be manipulated to conform to the size of a given roll of film or foil.

The present invention results in a significantly improved wrap dispensing system that provides ease of use and organization of the process of food storage and wrapping.

DETAILED DESCRIPTION OF THE PREFERRED EMBODIMENTS

As shown in FIGS. 1-11, the present invention is directed to a wrap dispenser that improves the organization and maintenance of critical job related tools including, dating labels, scissors, and marking pens.

Figure 1:
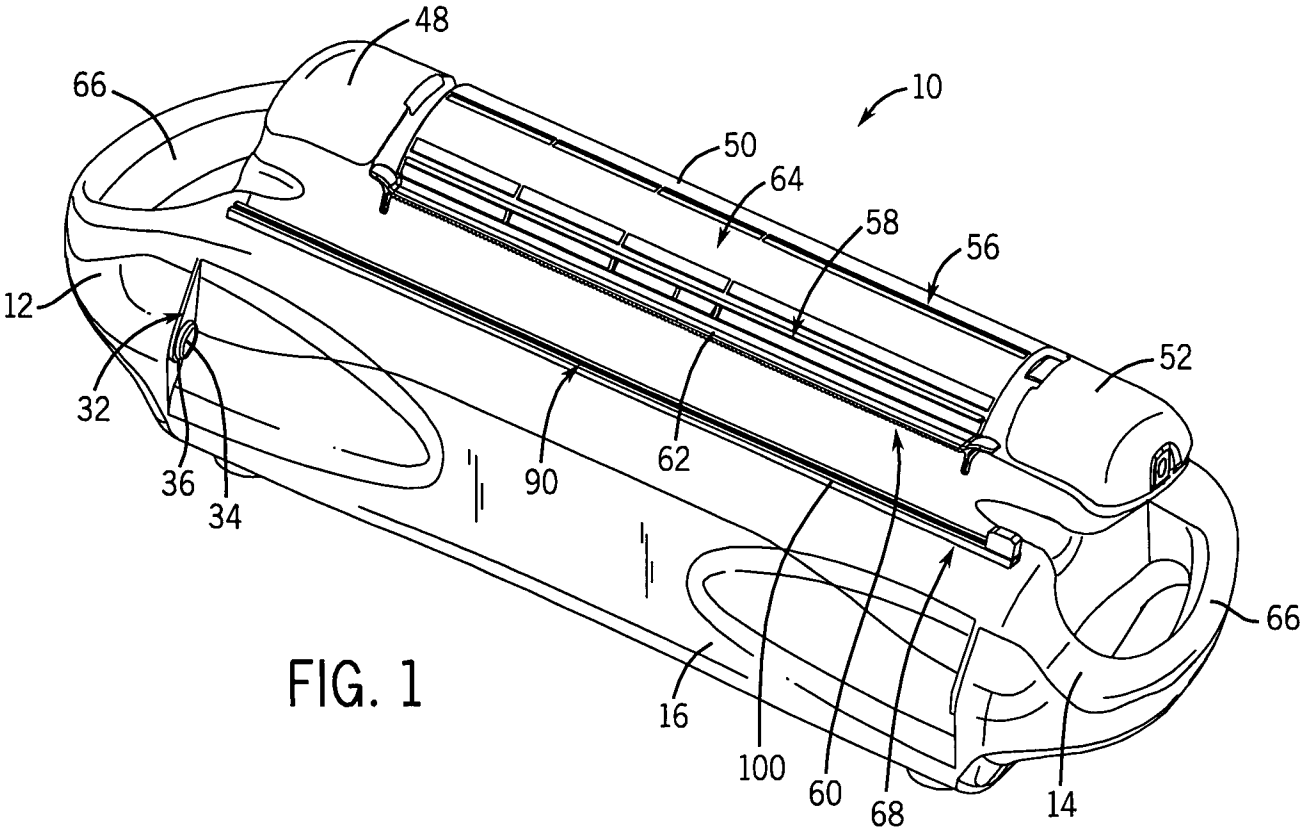
FIG. 1 is a front perspective view of one embodiment of the present invention.
Figure 11:
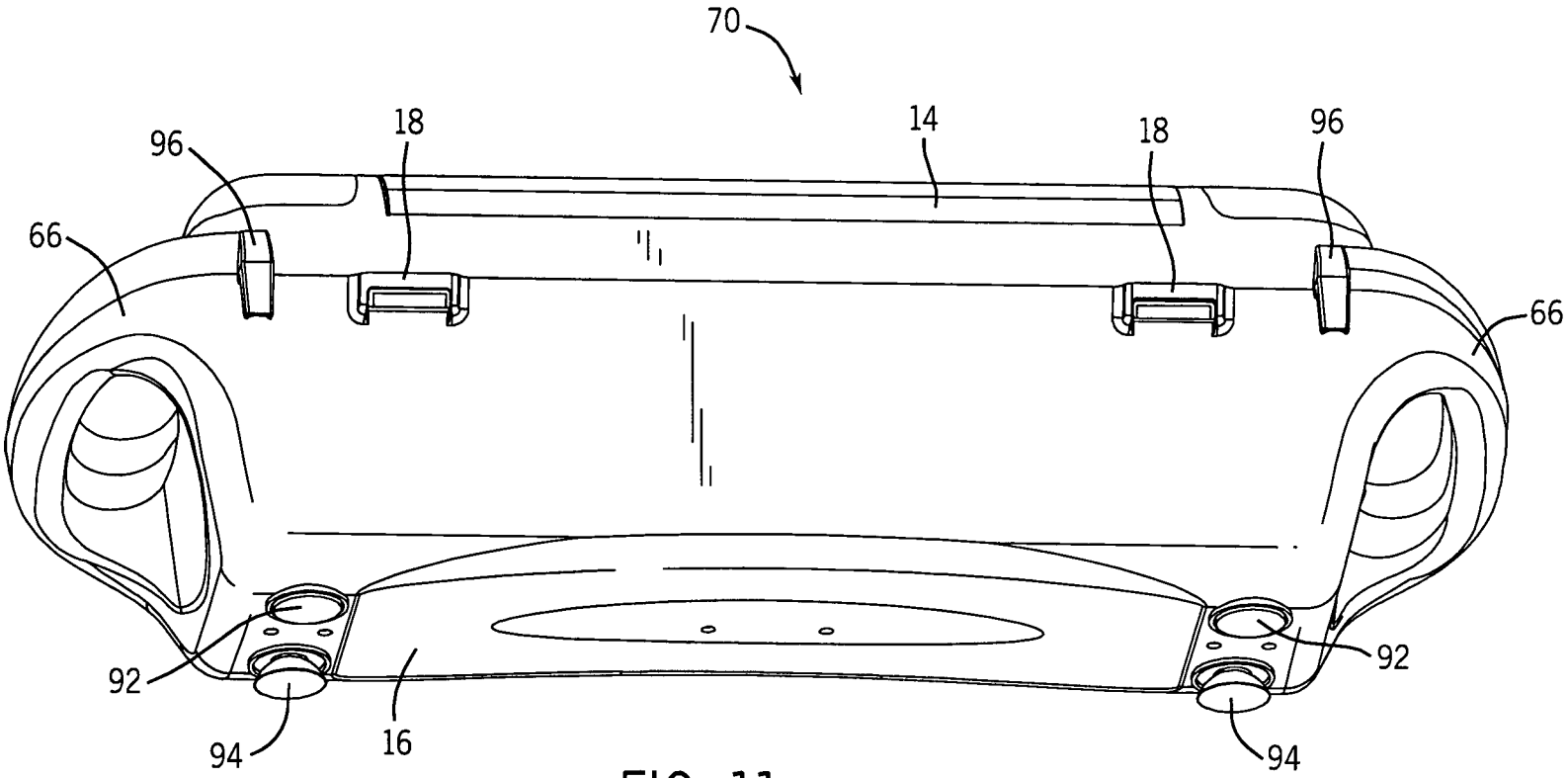
FIG. 11 is a bottom perspective view of the embodiment of the present invention shown in FIG. 1.

As can be best seen in FIGS. 1 and 11, wrap dispensing station 10 of the present invention has a housing 12 comprising a top portion 14 and a bottom portion 16. The two portions are joined together via a pair of hinges 18 such that the top portion 14 pivots with respect to the bottom portion 16 from a closed position to an open position. The hinges 18, are preferably constructed to permit the two portions 14 and 16 to be separated from each other without the use of tools to permit replacement of a damaged part or cleaning.

When the two portions 14 and 16 are in the closed position, a locking mechanism 32 comprising tabs 34 and receivers 36 engages to prevent the housing 12 from being accidentally opened. A pair of handles 66 are formed by the top and bottom portions 14 and 16, on either side of the dispensing station 10.

Figure 2:
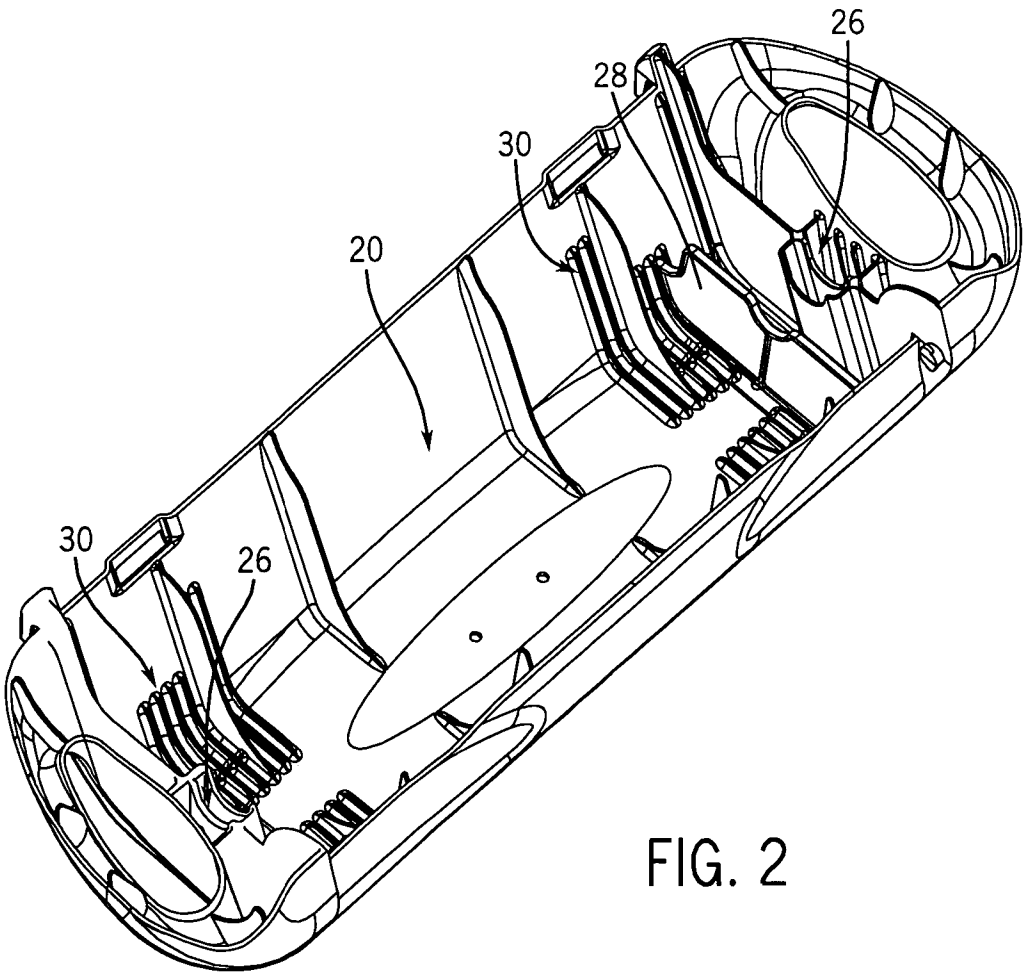
FIG. 2 is top perspective view of the bottom portion of the housing of FIG. 1.
Figure 3:
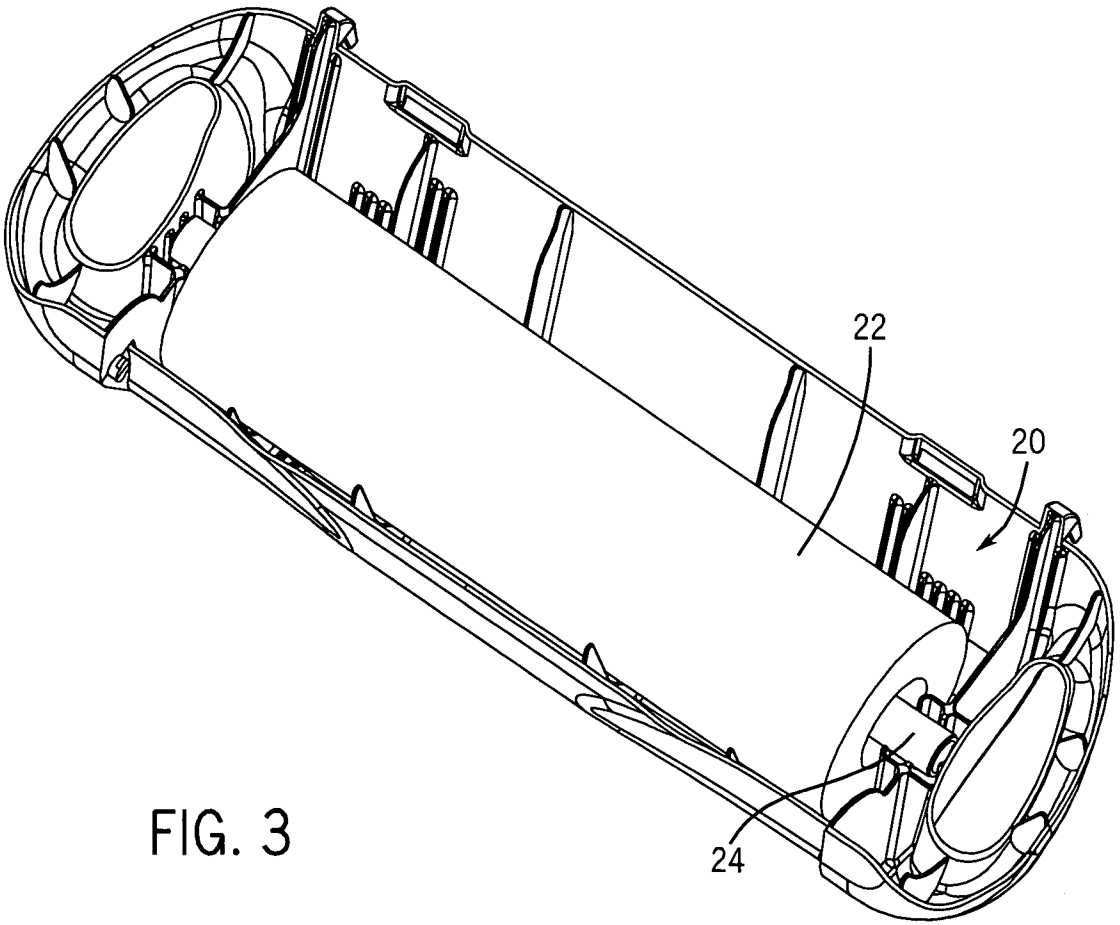
FIG. 3 is top perspective view of the bottom portion shown in FIG. 2 showing a roll of film or foil mounted in the bottom portion.

As shown in FIGS. 2 and 3, the bottom portion 16 provides a cavity 20 into which a roll of film or foil 22 is placed. The roll of film or foil 22 is mounted on a central longitudinal roll support bar 24 that is held in place on either end by supports 26. Where the roll of film or foil 22 is less than the full length of the cavity 20, at least one roll size adapter 28 is used to restrain the roll in place on the support bar 24. The adapter 28 is preferably in the form of a partition that fits into predefined grooves 30 in the floor of the cavity 20. Depending on the desired placement of the roll of film or foil 22 within the cavity 20, one or two adapters 28 may be used—one on either end of the roll 22.

Figure 4:
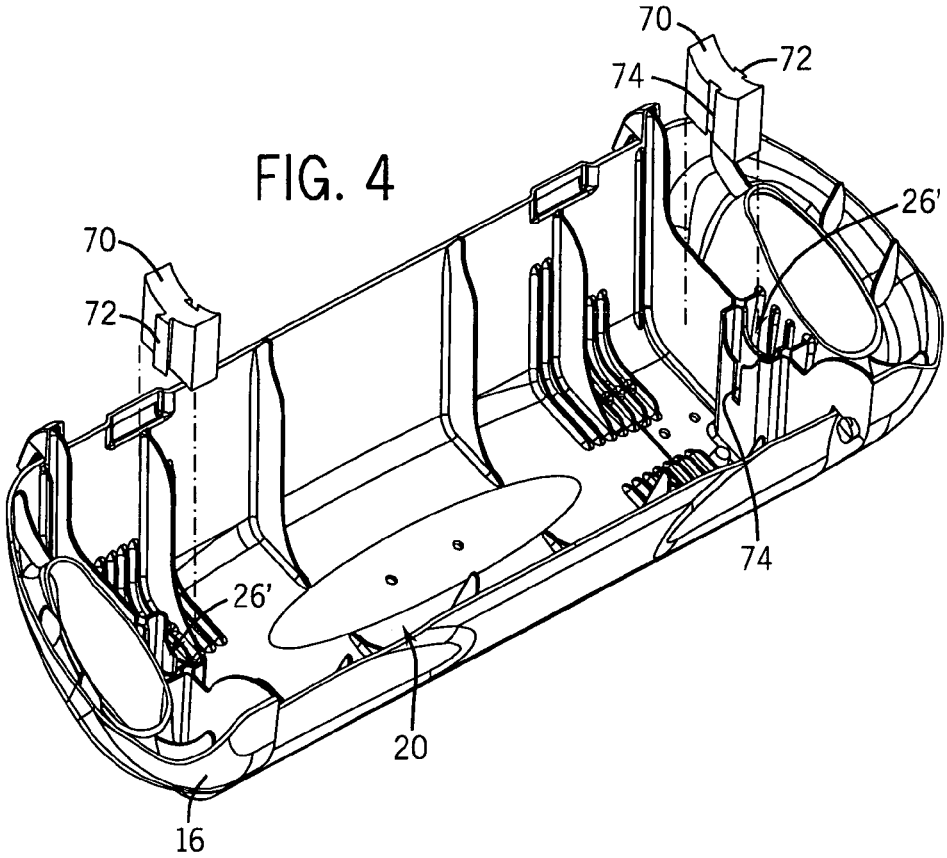
FIG. 4 is a top perspective view of a second embodiment of a roll size adjustment mechanism of the present invention.

Alternative embodiments of roll size adjustment mechanism of the present invention are shown in FIGS. 4-7. As shown in FIG. 4, one or more support extensions 70 can be added to the supports 26' to restrain a smaller sized roll of film or foil in a desired position. The support extensions 70 have a key 72 that slides into a corresponding keyway 74 in the supports 26'. Through this complementary interlocking system, additional support extensions can be added to accommodate still smaller rolls of film or foil by sliding the key in the additional support extensions into the corresponding keyway 74 in the previously mounted support extensions 72.

Figure 5:
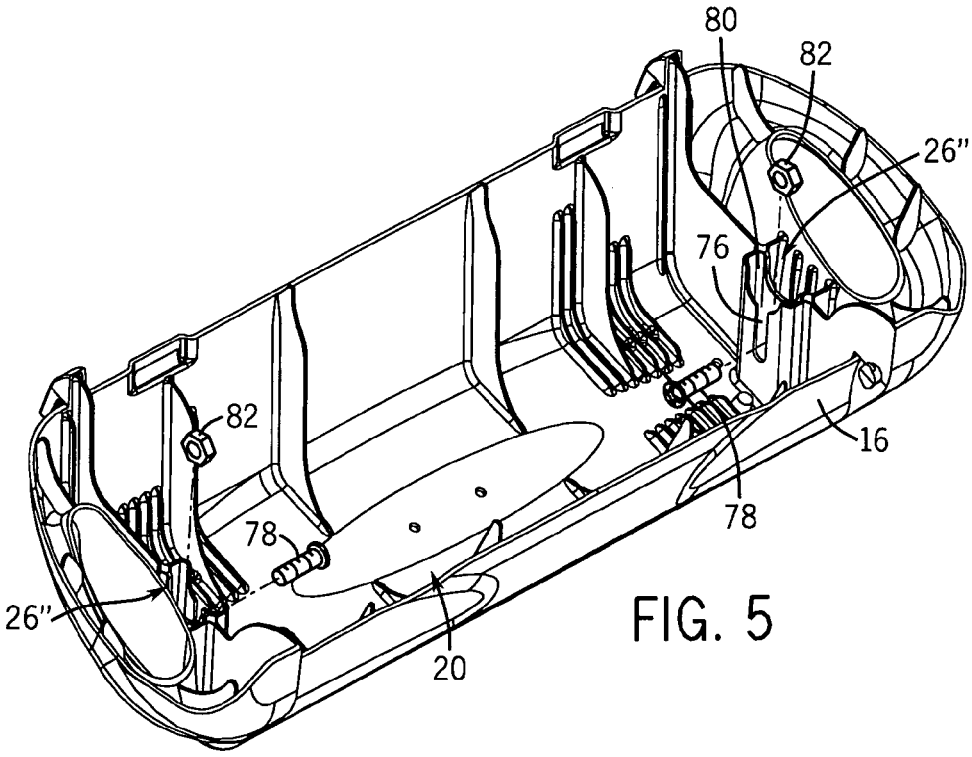
FIG. 5 is a top perspective view of a third embodiment of a roll size adjustment mechanism of the present invention.

As shown in FIG. 5, supports 26" can each include a slot 76 for receiving the threads of a bolt 78. A channel 80 accommodates a restrained nut 82 into which the bolt 78 is also threaded. The bolt(s) 78 can be threaded into or out of the channel 80 and nut 82 to restrain a roll of film or foil in a desired position. Since the bolt(s) 78 can be translated to any position corresponding to the ultimate length of the bolt(s), a precise restraining of a roll of film or foil can be achieved.

Figure 6:
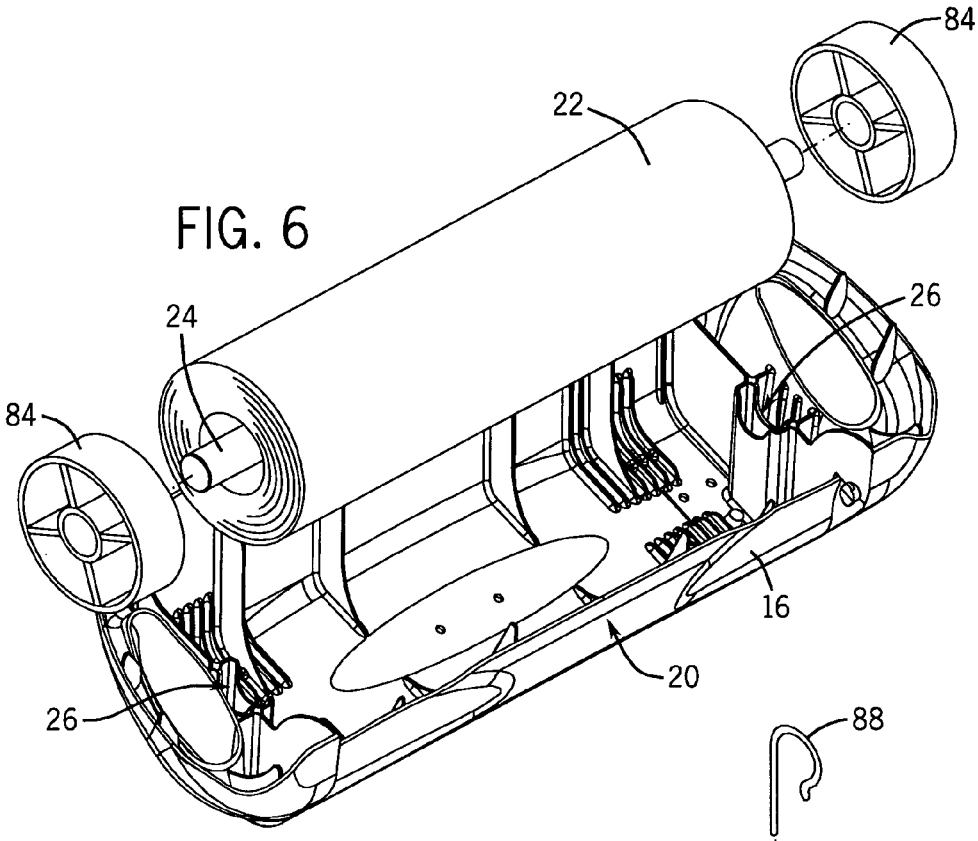
FIG. 6 is a top perspective view of a fourth embodiment of a roll size adjustment mechanism of the present invention.

As shown in FIG. 6, spacers 84 can be placed on either or both ends of a roll of film or foil mounted on the support bar 24. These spacers 84 can be made in multiple sizes or multiple spacers added, to accommodate and more precisely restrain different roll sizes of film or foil.

Figure 7:
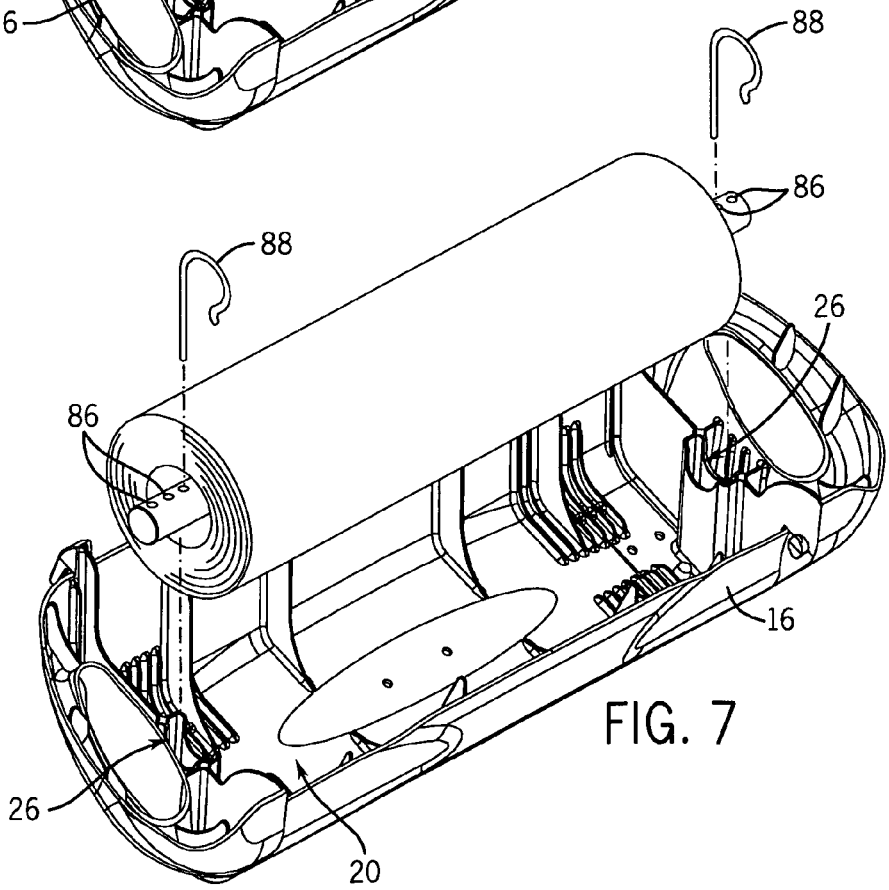
FIG. 7 is a top perspective view of a fifth embodiment of a roll size adjustment mechanism of the present invention.

As shown in FIG. 7, the support bar 24 can be provided with multiple slots 86 cut therein to accommodate restraining pins 88 such as cotter pins. When a roll of film or foil 22 is placed on the support bar 24, restraining pins 88 can be placed on one or both sides of the roll in the hole location nearest the preferred roll position. In this way, virtually any size roll of film or foil can be restrained so as to feed smoothly without significant lateral movement.

Figure 8:
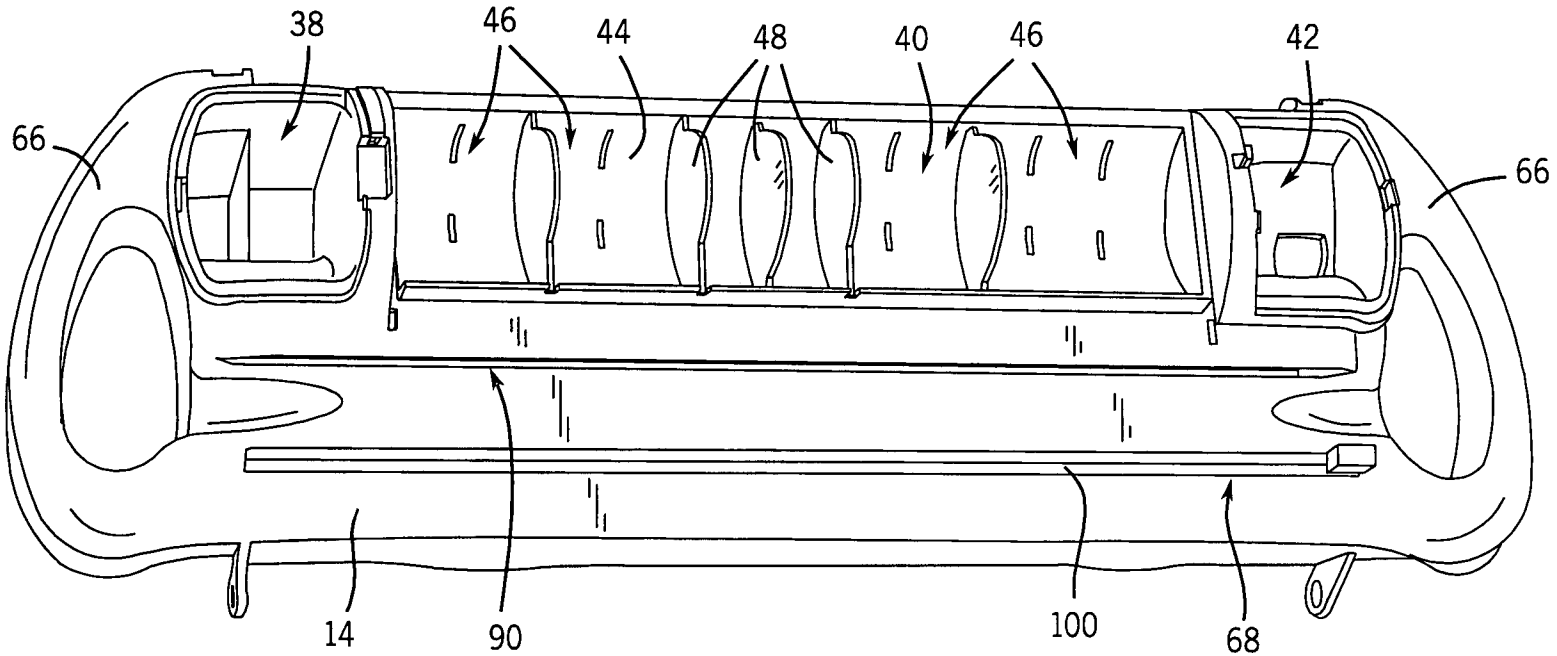
FIG. 8 is a top perspective view of the top portion of the housing of FIG. 1.

The top portion 14 of the housing 12 preferably has three recessed portions 38, 40 and 42. Recessed portions 38 and 42 are sized to accommodate standard sized scissors and markers. As can be seen in FIG. 8, the recesses 38 and 42 extend into the cavity 20 behind the roll of film or foil 22 when such a roll is mounted in place. Recessed portion 40 is an elongated area with a curved bottom portion 44 that can be divided into a plurality of sections 46 with one or more dividers 48. This recessed portion 40 is sized and shaped to accommodate rolls of labels 54, e.g., Dot-It food rotation labels, that are typically used to mark food that is to be wrapped and stored.

All three recessed portions 38, 40 and 42 are preferably covered by covers 48, 50 and 52. These covers, which are pivotally connected to the top portion 14 relative to the recessed portions 38, 40 and 42, respectively, can be used to isolate the contents of the recessed portions from liquids and other contamination. Preferably the cover 38, 40 and 42 are transparent to permit a user to check on the adequacy of the supply of labels, markers and scissors.

Preferably cover 50 has a series of elongated slots 56, 58 and 60 that, together with separator bar 62, form a label feeding system that can be used to facilitate the feeding, peeling and marking of labels. The cover 50 also comprises a semi-flat area 64 that can be used to facilitate writing on the labels.

A slidable cutting apparatus 68 is mounted in the top portion 14 of the housing 12. Preferably the cutting apparatus 68 is juxtaposed relative to a hold down mechanism 100 that maintains the film or foil to be dispensed in a temporarily fixed position. In one preferred embodiment of the present invention, the hold down mechanism comprises two strips of a material on either side of the blade portion (not shown) of cutting apparatus 68 that are sticky enough to maintain the film or foil in position while the blade portion is being translated for cutting. This facilitates the smooth function of the cutting apparatus 68 as well as keeping the leading edge of the film or foil extended from the roll 22.

In yet another embodiment of the present invention, the cutting apparatus 68 is in the form of a toothed strip of plastic or metal that can applied to the film or foil to cut the film or foil at a desired length.

In use, a roll of film or foil 22 is slid onto the support bar 24. If necessary, the position of the roll 22 can be restrained by using any of the roll size adjustment mechanisms shown in FIGS. 4-7. The bar 24 with the roll 22 is then placed on supports 26 within the lower portion 16 or the housing 12. The leading edge of the film or foil is then extended from the roll 22 and fed through slot 90 in the upper portion 14 of the housing 12 and temporarily fixed on hold down mechanism 100.

Food rotation labels are loaded into the label recess portion 40 and the dividers 48 positioned as necessary to create appropriately sized sections 46 for the labels. The leading edge of each roll of labels is then fed through slots 56 and 60 and the cover 50 closed.

Markers (not shown) and scissors (not shown) are placed in recesses 38 and 42 as necessary for appropriate marking and cutting of food products to be wrapped and stored. The covers 48 and 52 are then closed until the markers and/or scissors are needed.

The wrap dispensing station 10 is placed in position and removably fixed in that position by its non-slip feet 92 and 94, at least two of which are preferably in the form of suction cups 94, or by hanging or mounting the station 10 with mounting hooks 96. If the station 10 needs to be moved, it can be picked up and carried vertically by either of the handles 66, without losing or dropping any of the stored markers, scissors or labels.

Figure 9:
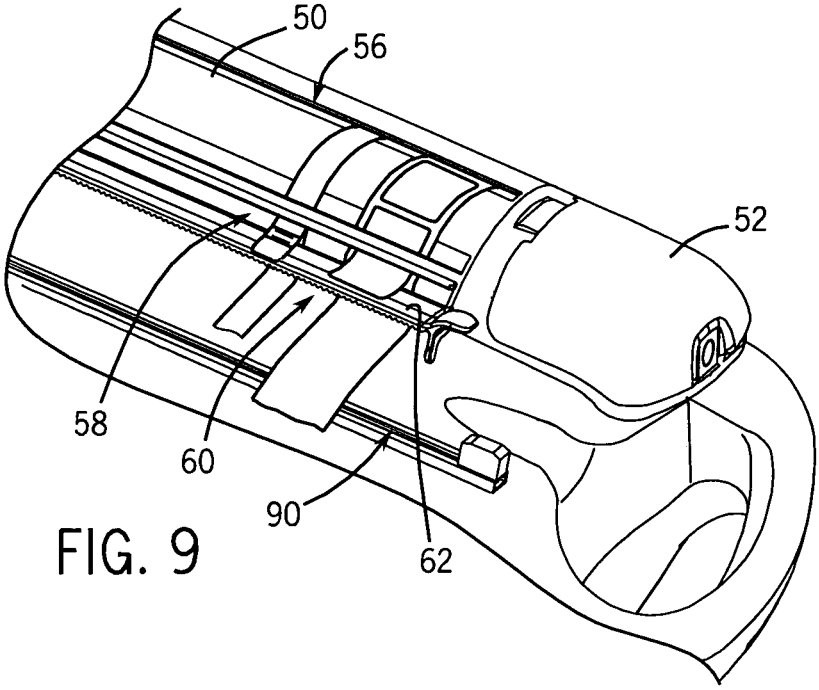
FIG. 9 is partial side perspective view of one embodiment of the present invention showing the label dispensing system of the present invention.
Figure 10:
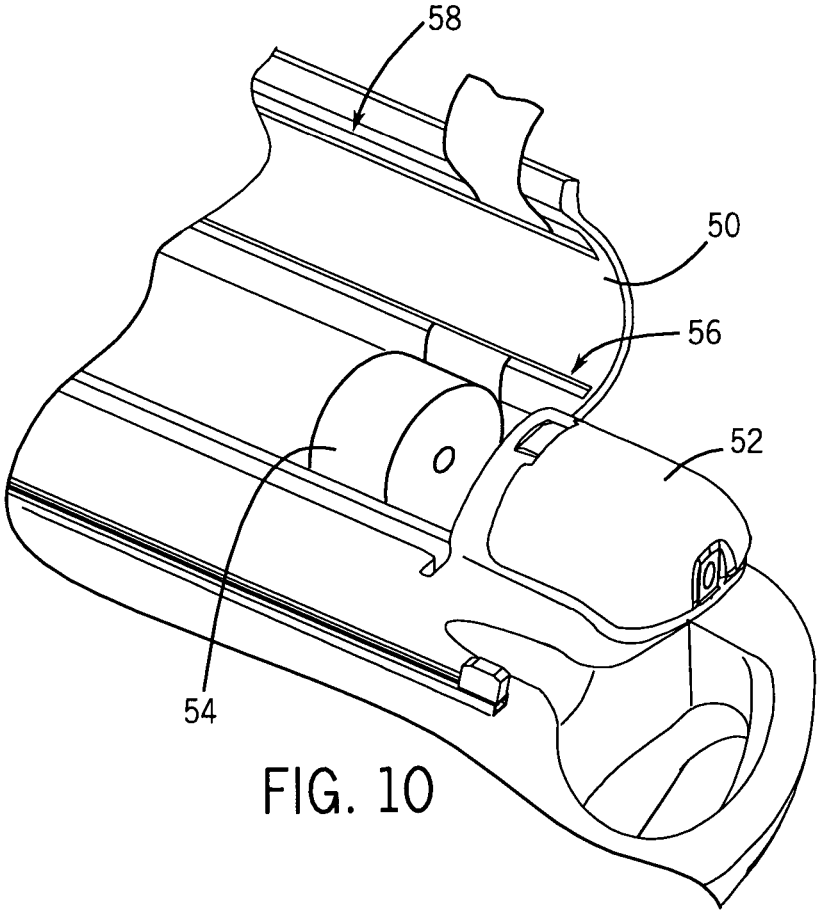
FIG. 10 is a partial perspective view of the label dispensing system of FIG. 9 with the cover in its open position.

When a user needs to wrap and store a food product, the leading edge of the film or foil extending from slot 90 is pulled to extract the desired amount of film or foil to be used for wrapping. The slidable cutting apparatus 68 is then employed to cut off that length of film or foil from the roll 22. Once the food items is wrapped, one or more labels may be selected for use. If the user needs to mark on the label, he or she selects a marker stored in one of the recesses 38 or 42 and marks on the label exposed on the cover 50 in the semi-flat area 64. To dispense the label, as shown in FIGS. 9 and 10, the user grasps the leading edge of roll of labels, usually the backer material on which the labels are mounted, and pulls it through slot 60. This causes separator bar 62 to "pick" the next label off the backer material. The label can then be placed on the wrapped food product and the product stored for later use.

The present invention may be implemented in a variety of configurations, using certain features or aspects of the several embodiments described herein and others known in the art. Thus, although the invention has been herein shown and described in what is perceived to be the most practical and preferred embodiments, it is to be understood that the invention is not intended to be limited to the specific features and embodiments set forth above. Rather, it is recognized that modifications may be made by one of skill in the art of the invention without departing from the spirit or intent of the invention and, therefore, the invention is to be taken as including all reasonable equivalents thereof.

The invention claimed is:

1. A wrap dispensing station comprising;

a housing having a first cavity configured to receive a roll of material to be dispensed;

a first cover pivotably coupled to the housing to selectively dose the first cavity;

a cutting apparatus mounted in the housing for cutting lengths of material to be dispensed;

a second cavity formed in the first cover;

at least one divider removably coupled to the first cover and operative to partition the second cavity into at least two recesses, wherein the recesses are adapted for storing items used in wrapping and storing food items; and a second cover for covering at least a portion of the second cavity.

2. A wrap dispensing station according to claim 1, further comprising a roll size adjustment mechanism.

3. A wrap dispensing station according to claim 1, further comprising a label feeding system.

4. A wrap dispensing station according to claim 3, wherein the first cover includes a relatively flat exterior surface usable as a writing area.

5. A wrap dispensing station according to claim 3, wherein said label feeding system comprises one of said recesses and at least a portion of the second cover.

6. A wrap dispensing station according to claim 1, wherein each of said recesses is associated with a cover.

7. A wrap dispensing station according to claim 1, wherein said cutting apparatus includes at least one surface for gripping the material to be dispensed.

8. The wrap dispensing station of claim 1 further comprising a separator bar spaced between the cutting apparatus and the plurality of recesses, and wherein the separator includes a serrated edge for cutting items dispensed from a recess.

9. The wrap dispensing station of claim 1 wherein the cutting apparatus includes a knife slidably mounted to a hold down mechanism configured to hold down material extended from the roll of material.

10. The wrap dispensing station according to claim 1, further comprising at least one handle integrally formed with the housing.

* * * * *

UNITED STATES PATENT AND TRADEMARK OFFICE

CERTIFICATE OF CORRECTION

PATENT NO. : 8,596,031 B2
APPLICATION NO. : 11/438192
DATED : December 3, 2013
INVENTOR(S) : Jayson Pearl et al.

It is certified that error appears in the above-identified patent and that said Letters Patent is hereby corrected as shown below:

IN THE CLAIMS

Claim 1, column 5, line 18, delete "dose" and substitute therefor -- close --.

Signed and Sealed this
Twelfth Day of August, 2014

Michelle K. Lee

Michelle K. Lee
*Deputy Director of the United States Patent and Trademark Office*